US008820886B2

(12) United States Patent
Eguchi et al.

(10) Patent No.: US 8,820,886 B2
(45) Date of Patent: Sep. 2, 2014

(54) LIQUID DISCHARGING HEAD AND LIQUID DISCHARGING APPARATUS WITH LIQUID REPELLANT FILM

(71) Applicant: Seiko Epson Corporation, Tokyo (JP)

(72) Inventors: Masayuki Eguchi, Shiojiri (JP); Shigeki Suzuki, Shiojiri (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/849,984

(22) Filed: Mar. 25, 2013

(65) Prior Publication Data

US 2013/0342605 A1 Dec. 26, 2013

(30) Foreign Application Priority Data

Jun. 21, 2012 (JP) ..... 2012-139476
Feb. 5, 2013 (JP) ..... 2013-020876

(51) Int. Cl.
*B41J 2/165* (2006.01)
*B41J 2/14* (2006.01)

(52) U.S. Cl.
CPC ..... *B41J 2/16505* (2013.01); *B41J 2/165* (2013.01); *B41J 2/1433* (2013.01); *B41J 2/14233* (2013.01); *B41J 2002/14362* (2013.01)
USPC ..... 347/29; 347/20; 347/33

(58) Field of Classification Search
USPC ..... 347/20, 29, 44, 45, 47, 49, 68, 71
See application file for complete search history.

(56) References Cited

U.S. PATENT DOCUMENTS 7,540,596 B2 * 6/2009 Hiwada ..... 347/71
7,992,964 B2 * 8/2011 Yanagisawa et al. ..... 347/47
2011/0234700 A1 9/2011 Kobayashi et al.

FOREIGN PATENT DOCUMENTS

JP 2011000778 A * 1/2011
JP 2011-201170 10/2011
JP 2012218255 A * 1/2012

* cited by examiner

*Primary Examiner* — Juanita D Jackson
(74) *Attorney, Agent, or Firm* — Workman Nydegger

(57) ABSTRACT

A liquid discharging head includes a liquid discharging head that has a nozzle plate on which a nozzle is formed, a cover that is provided at a periphery of the nozzle plate, and a liquid repellent film that are provided on surfaces of the nozzle plate and the cover which are opposed to a discharge target. In the liquid discharging head, a recess defined by the cover and the nozzle plate is filled with a filler and inner surfaces of the recess are covered by the filler.

18 Claims, 11 Drawing Sheets

LIQUID DISCHARGING HEAD AND LIQUID DISCHARGING APPARATUS WITH LIQUID REPELLANT FILM

CROSS REFERENCES TO RELATED APPLICATIONS

The entire disclosure of Japanese Patent Application Nos. 2012-139476, filed Jun. 21, 2012 and 2013-020876, filed Feb. 5, 2013 are incorporated by reference herein.

BACKGROUND

1. Technical Field

The present invention relates to a liquid discharging head and a liquid discharging apparatus.

2. Related Art

An existing liquid discharging head that discharges liquid droplets through nozzles by applying pressure to liquid by pressure generation units such as piezoelectric actuators or heating elements has been known. As a representative example thereof, an ink jet recording head that discharges ink droplets has been disclosed in JP-A-2011-201170, for example.

However, types of ink available are increased with diversified recording modes and there arises the following problem in the liquid discharging head as described in JP-A-2011-201170. That is, there arises the problem that wiping performance on an ink discharge surface is not preferable in a head cleaning operation. To be more specific, for example, when ink having higher viscosity than that of the existing ink is used, ink tends to be accumulated easily in even slight recesses formed on the ink discharge surface of a nozzle plate. Since the ink viscosity is high, ink accumulation cannot be eliminated easily even if ink is wiped out with the existing method in some cases. As a result, the accumulated ink is left and an accumulation amount is increased so that the wiping performance is further deteriorated. This causes solidification of ink on the ink discharge surface or in nozzles, resulting in deterioration of ejected ink performance to be discharged, discharge incapability (discharge deterioration), or the like.

It is to be noted that the above-mentioned problem arises not only on ink but also on other matters that adhere to the ink discharge surface and the same problem occurs for a case where liquid other than ink is discharged.

SUMMARY

An advantage of some aspects of the invention is to provide a liquid discharging head and a liquid discharging apparatus that can improve wiping performance on an ink discharge surface and can suppress ink accumulation.

A liquid discharging head according to an aspect of the invention includes a liquid discharging head that has a nozzle plate on which a nozzle for discharging liquid onto a discharge target is formed, a cover that is provided at a circumference of the nozzle plate, and liquid repellent films that are provided on surfaces of the nozzle plate and the cover which are opposed to the discharge target. In the liquid discharging head, a recess defined by the cover and the nozzle plate is filled with a filler.

The recess is filled with the filler so that when liquid on the liquid discharge surface is wiped out, liquid accumulation to be generated in the recess can be suppressed. Accordingly, when the liquid discharging head is an ink jet recording head included in an ink jet printer using ink as the liquid, for example, the ink jet recording head and the ink jet printer that improve ink wiping performance on the ink discharge surface of the nozzle plate can be provided. An expression that the cover is provided at the outer circumference side is not limited to a state where the cover is provided on the entire outer circumference and means a state where the cover is provided on at least a part of the outer circumference.

In the liquid discharging head according to the aspect of the invention, it is preferable that the filler have insulating property. The filler has the insulating property so that static electricity can be suppressed from reaching the liquid discharging head through the recess.

In the liquid discharging head according to the aspect of the invention, it is preferable that the liquid repellent film be not formed on the recess. The liquid repellent film is formed so that only the recess can be filled with the filler.

In the liquid discharging head according to the aspect of the invention, it is preferable that the nozzle plate and the cover be provided to be separated from each other, and the recess be formed by an end surface of the nozzle plate and an end surface of the cover that are opposed to each other, and the recess be filled with the filler.

In the liquid discharging head according to the aspect of the invention, it is preferable that the filler does not extend to the discharge target side relative to the liquid repellent film provided on the cover. The filler does not extend to the discharge target side relative to the liquid repellent film provided on the cover, thereby improving the wiping performance.

In the liquid discharging head according to the aspect of the invention, it is preferable that an insulating film be formed on at least a surface of the cover that is opposed to the discharge target.

In the liquid discharging head according to the aspect of the invention, it is preferable that the filler be made of a cured liquid-like epoxy-based adhesive. The filler is formed by the liquid-like epoxy-based adhesive so that the filler is easy to spread in the recess so as to fill an opening of the recess smoothly (in a slope form). Further, the filler is formed by the liquid-like epoxy-based adhesive so that erosion by the liquid into the filler can be suppressed so as to keep the slope form. This can prevent the liquid wiping performance from being deteriorated.

A liquid discharging apparatus according to another aspect of the invention includes the liquid discharging head according to any of the above-mentioned aspects. The liquid discharging apparatus includes the liquid discharging head according to any of the above-mentioned aspects so as to provide the liquid discharging apparatus that can improve the liquid wiping performance on the liquid discharge surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention is described in detail based on embodiments.

First Embodiment

Figure 1:
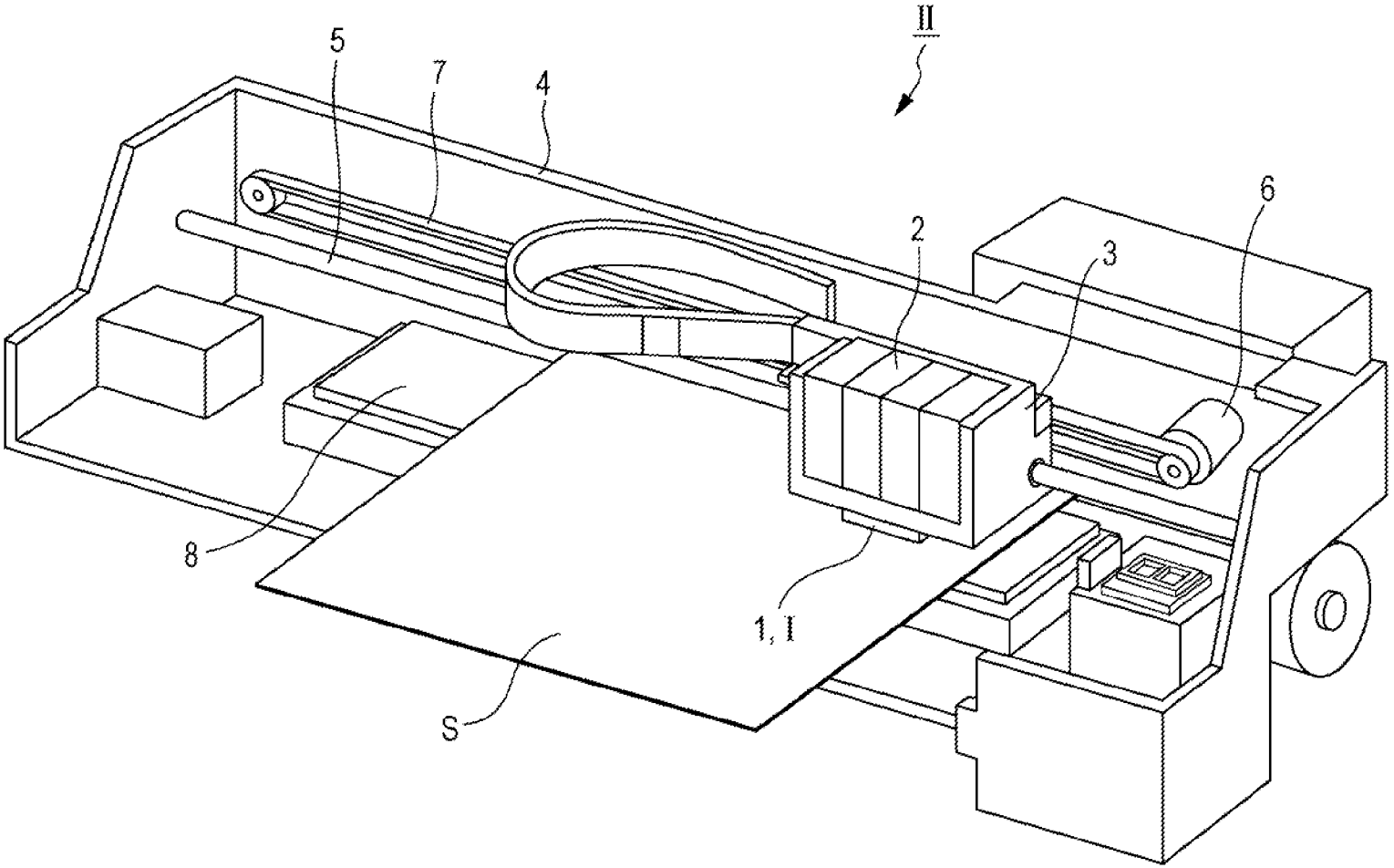
FIG. 1 is a schematic view illustrating a liquid discharging apparatus including a liquid discharging head according to a first embodiment.

FIG. 1 is a schematic view illustrating a liquid discharging apparatus II including liquid discharging heads I according to a first embodiment.

The liquid discharging apparatus II is an ink jet printer and includes a central processing unit (CPU), a control IC (not illustrated), a head unit 1, a carriage 3, an apparatus main body 4, a carriage shaft 5, a driving motor 6, a timing belt 7, and the like.

The head unit 1 is constituted by including a plurality of liquid discharging heads I. A plurality of ink cartridges 2 are provided on the head unit 1 in a detachable manner. The ink cartridges 2 constitute a unit for supplying ink as liquid. The carriage 3 on which the head unit 1 is mounted is provided on the carriage shaft 5 attached to the apparatus main body 4 so as to be movable in the shaft direction. The head unit 1 discharges black ink composition and color ink compositions, for example, that are accommodated in the ink cartridges 2.

If a driving force of the driving motor 6 is transmitted to the carriage 3 through a plurality of gears (not illustrated) and the timing belt 7, the carriage 3 on which the head unit 1 is mounted is moved along the carriage shaft 5. On the other hand, a platen 8 is provided on the apparatus main body 4 along the carriage shaft 5. A recording sheet S as a recording medium such as paper fed by a paper feeding roller (not illustrated) and the like is transported onto a platen 8.

Further, in the above-mentioned liquid discharging apparatus II in which the head unit 1 is mounted on the carriage 3 and is moved in the main scanning direction has been described. However, the invention is not particularly limited thereto. For example, the invention can be also applied to a so-called line-type recording apparatus in which the head unit 1 is fixed and printing is performed by moving the recording sheet S such as paper in the sub scanning direction only.

Figure 2:
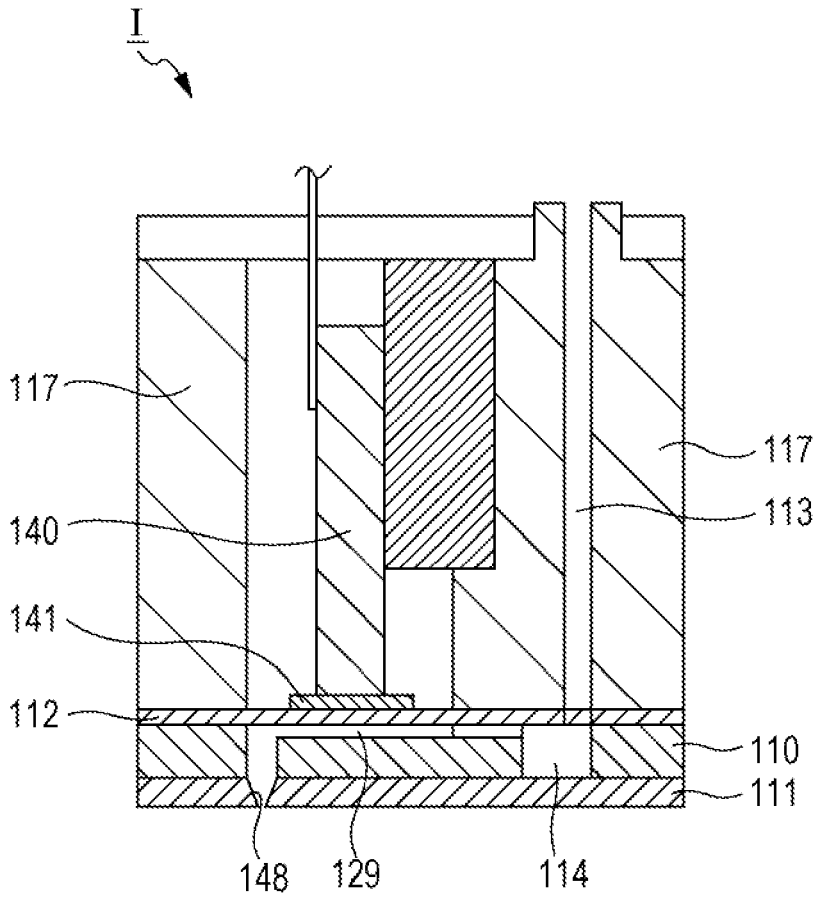
FIG. 2 is a cross-sectional conceptual view for explaining operations of a head unit.

FIG. 2 is a cross-sectional conceptual view for explaining operations of the liquid discharging head I.

The liquid discharging head I is configured by including an ink supply path 113, a reservoir 114, a pressure generation chamber 129, a nozzle 148, a flow path formation substrate 110, a nozzle plate 111, a piezoelectric actuator 140, a case 117, and the like.

Ink to be supplied from the ink cartridge 2 is moved to the ink supply path 113 formed in the case 117, the reservoir 114 also formed in the case 117, and the pressure generation chamber 129 formed in the flow path formation substrate 110. A print signal transmitted from the CPU is transmitted to the control IC. The print signal is converted to a control signal for the pressure generation chamber 129 and a driving signal for discharging ink is transmitted to the piezoelectric actuator 140. The front end of the piezoelectric actuator 140 applies pressure to the pressure generation chamber 129 through an island portion 141 for reinforcement and an elastic plate 112 forming a vibration plate. The ink moved to the pressure generation chamber 129 receives the pressure to be discharged onto a recording sheet S (FIG. 1) as ink droplets through the nozzle 148 formed on the nozzle plate 111.

It is to be noted that description has been made by using an example in which one nozzle 148 is provided on the nozzle plate 111 in FIG. 2. However, the liquid discharging head I includes a plurality of pressure generation chambers 129 and a plurality of nozzles 148 communicating with the pressure generation chambers 129 and a plurality of rows of the nozzles 148 are formed on the nozzle plate 111.

Figure 3A:
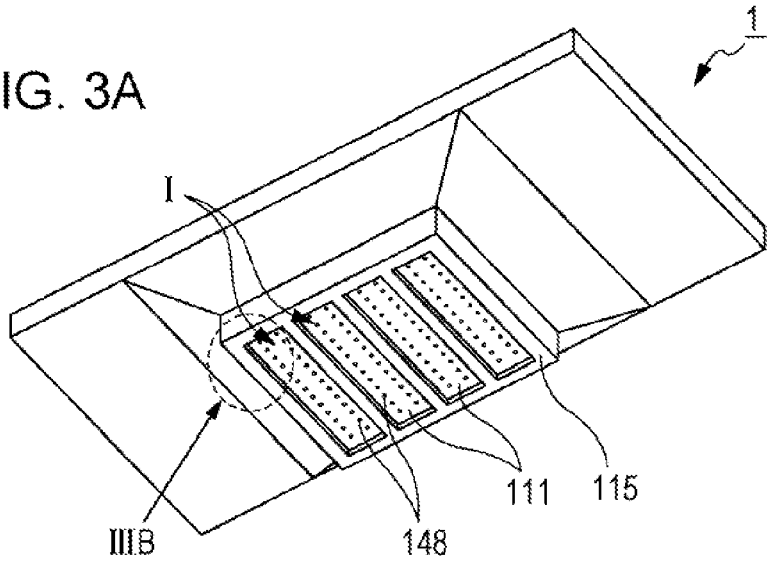
FIGS. 3A, 3B, and 3C are schematic views illustrating an existing liquid discharging head.
Figure 3B:
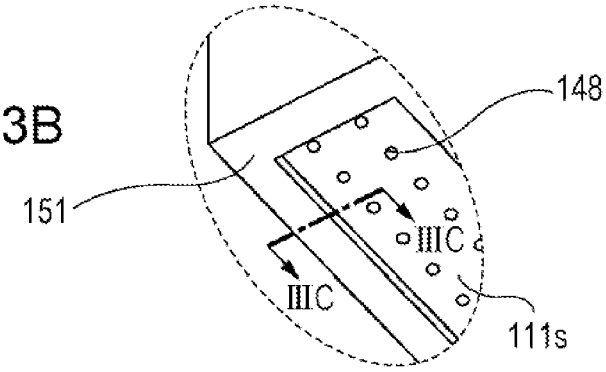
Figure 3C:
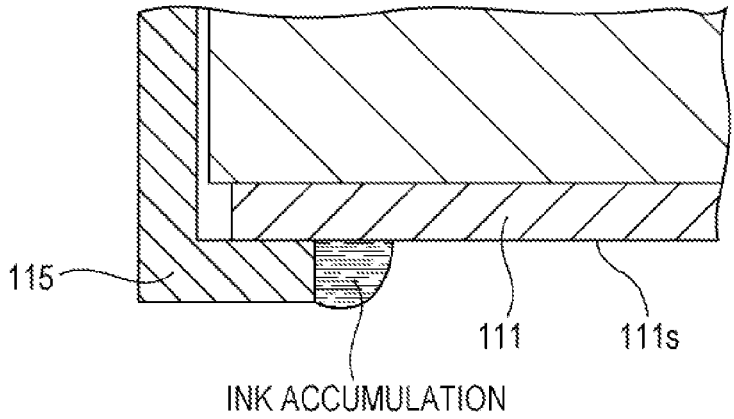

FIGS. 3A, 3B, and 3C are schematic views illustrating an existing liquid discharging head.

FIG. 3A is a perspective view illustrating the head unit 1 when seen from the side of the recording sheet S as illustrated in FIG. 1.

The head unit 1 is configured such that a plurality of (four in FIG. 3A) liquid discharging heads I are gathered by a fixing plate 115 to be fixed and held.

FIG. 3B is an enlarged view illustrating a portion IIIB in FIG. 3A. FIG. 3B illustrates a state where the fixing plate (cover) 115 abuts against a discharge surface (ink discharge surface 111*s*) of the nozzle plate 111 constituting each liquid discharging head I in a frame-like manner to hold the nozzle plate 111. Note that ink is to be discharged from the discharge surface (ink discharge surface 111*s*). In the embodiment, the fixing plate 115 is provided at the outer circumferential sides of the nozzle plates 111.

Ink to be discharged through the nozzles 148 remains while adhering to the surroundings of the nozzles 148 in some cases. When the remaining ink is cleaned by wiping the ink discharge surfaces 111*s*, the ink tends to be accumulated on recesses shaped by steps formed by the fixing plate 115 abutting against the ink discharge surfaces 111*s* in the frame-like manner.

FIG. 3C is a cross-sectional view cut along a line IIIC-IIIC in FIG. 3B and illustrates the ink accumulation state. The ink is accumulated in the recesses shaped by the steps formed between the ink discharge surfaces 111*s* and the end portions of the fixing plate 115. If the accumulated ink is left and an accumulation amount is increased, wiping performance on the ink discharge surfaces 111*s* is deteriorated. This causes solidification of ink on the ink discharge surfaces 111*s* or in the nozzles 148, resulting in deterioration of ejected ink performance to be discharged and discharge incapability (discharge deterioration).

Figure 4A:
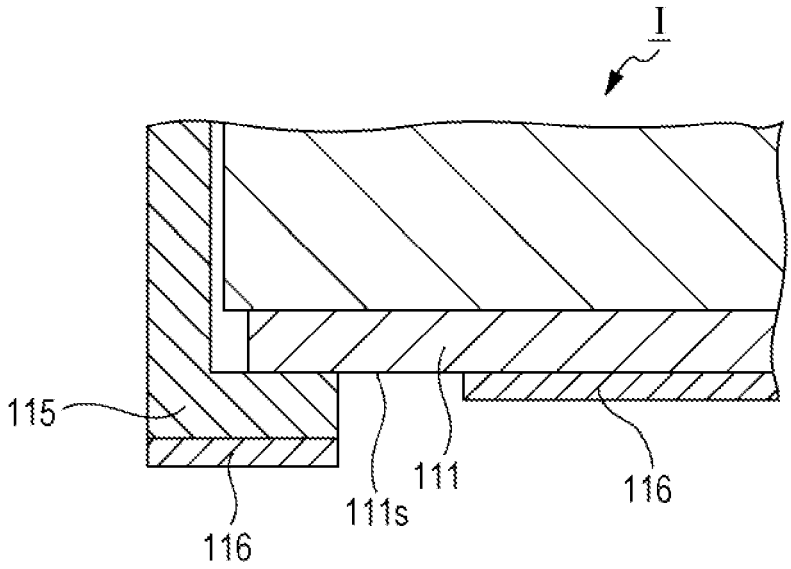
FIGS. 4A and 4B are cross-sectional views for explaining the liquid discharging head according to the first embodiment.
Figure 4B:
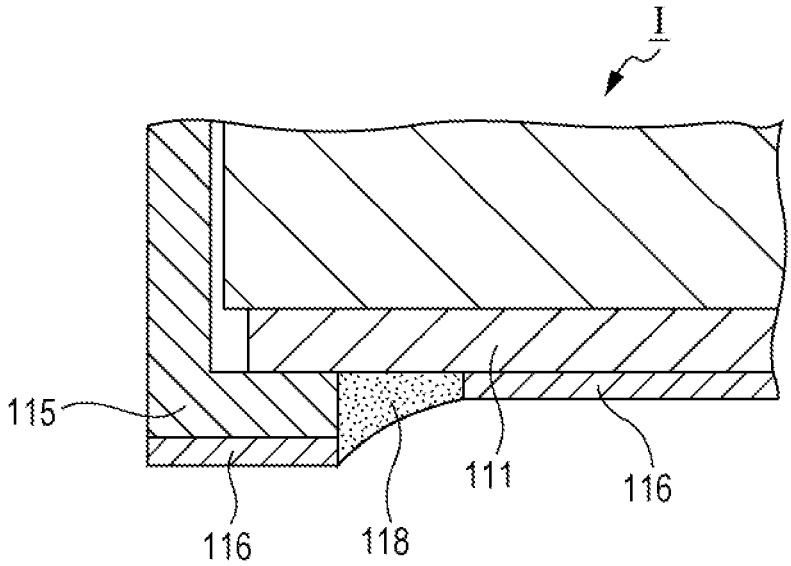

FIGS. 4A and 4B are cross-sectional views for explaining the head unit 1 according to the first embodiment.

As illustrated in FIG. 4B, in the head unit 1, a filler 118 for forming step portions (recesses) in the slope forms is provided on the step portions formed by the end surfaces of the fixing plate 115 that abut against the ink discharge surfaces 111*s*, the end surfaces of the nozzle plates 111, and water repellent films 116. The water repellent films 116 are formed on the ink discharge surfaces 111*s* other than the regions on which the filler 118 is provided and the regions covered by the fixing plate 115. In other words, the water repellent films 116 are formed on the ink discharge surfaces 111*s* at the inner sides that are surrounded by the filler 118. Each nozzle 148 is provided so as to penetrate through the water repellent film 116 and the nozzle plate 111.

The head unit 1 in the embodiment has the same configuration as the head unit 1 as illustrated in FIGS. 3A to 3C other than the configuration in which the filler 118 and the water repellent films 116 are provided on the ink discharge surfaces 111*s*.

FIG. 4A illustrates a state where the water repellent films 116 are formed on each ink discharge surface 111*s* and the fixing plate 115 before the filler 118 is provided.

The water repellent films 116 are provided by selectively forming a water repellent material in a film form on the ink discharge surfaces 111*s* other than the regions against which the fixing plate 115 abuts and the regions on which the filler 118 is provided. The water repellent material is formed by screen printing or photolithography at a manufacturing stage of the nozzle plates 111. The water repellent material is also formed on the fixing plate 115 in the film form. To be more specific, the water repellent material is formed on the surface of the fixing plate 115 that is opposed to the discharge target, that is, on the outer surfaces of the liquid ejecting heads I that are parallel with the ink discharge surfaces 111*s*. The films correspond to the water repellent films (liquid repellent films) 116. It is to be noted that a method in which the nozzle plates 111 assembled on the liquid discharging heads I are fixed by the fixing plate 115, and then, the water repellent films 116 are formed may be employed.

A liquid-like epoxy-based adhesive is used for the filler 118, as a preferable example. That is to say, the filler 118 is made of the cured epoxy-based adhesive. The filler 118 is provided in the following manner. That is, after the water repellent films 116 have been formed, the epoxy-based adhesive is applied to the step portions formed by the end portions of the fixing plate 115 and the ink discharge surfaces 111*s* on regions on which the water repellent films 116 are not formed.

As described above, with the head unit 1 according to the embodiment, the following effects can be obtained.

The steps formed by the nozzle plates 111 and the fixing plate 115 are shaped into the slope forms. Therefore, when ink on the ink discharge surfaces 111*s* is wiped out, ink accumulation generated on the steps can be suppressed.

Accordingly, a liquid discharging head and a liquid discharging apparatus that improve ink wiping performance on an ink discharge surface can be provided.

Further, the ink discharge surfaces 111*s* repel ink with the water repellent films 116 so that the wiping performance on the ink discharge surfaces 111*s* is improved. This makes it possible to suppress discharge deterioration.

The filler 118 is formed by the liquid-like epoxy-based adhesive so that the filler 118 is easy to spread on the step portions and prevent expansion of the filler 118 to the ink discharge surfaces 111*s* with the steps of the water repellent films 116. Therefore, the slopes can be formed easily. In addition, the liquid-like epoxy-based adhesive is solidified so that erosion by the ink can be suppressed so as to keep the slope forms. This can prevent the ink wiping performance from being deteriorated.

Further, a liquid discharging apparatus that improves ink wiping performance on an ink discharge surface can be provided by using the above-mentioned head unit 1 as the liquid discharging head.

Second Embodiment

In the embodiment, a liquid discharging head has a configuration different from that in the first embodiment. Hereinafter, the configuration of an ink jet recording head is described with reference to FIG. 5 to FIG. 9.

Figure 5:
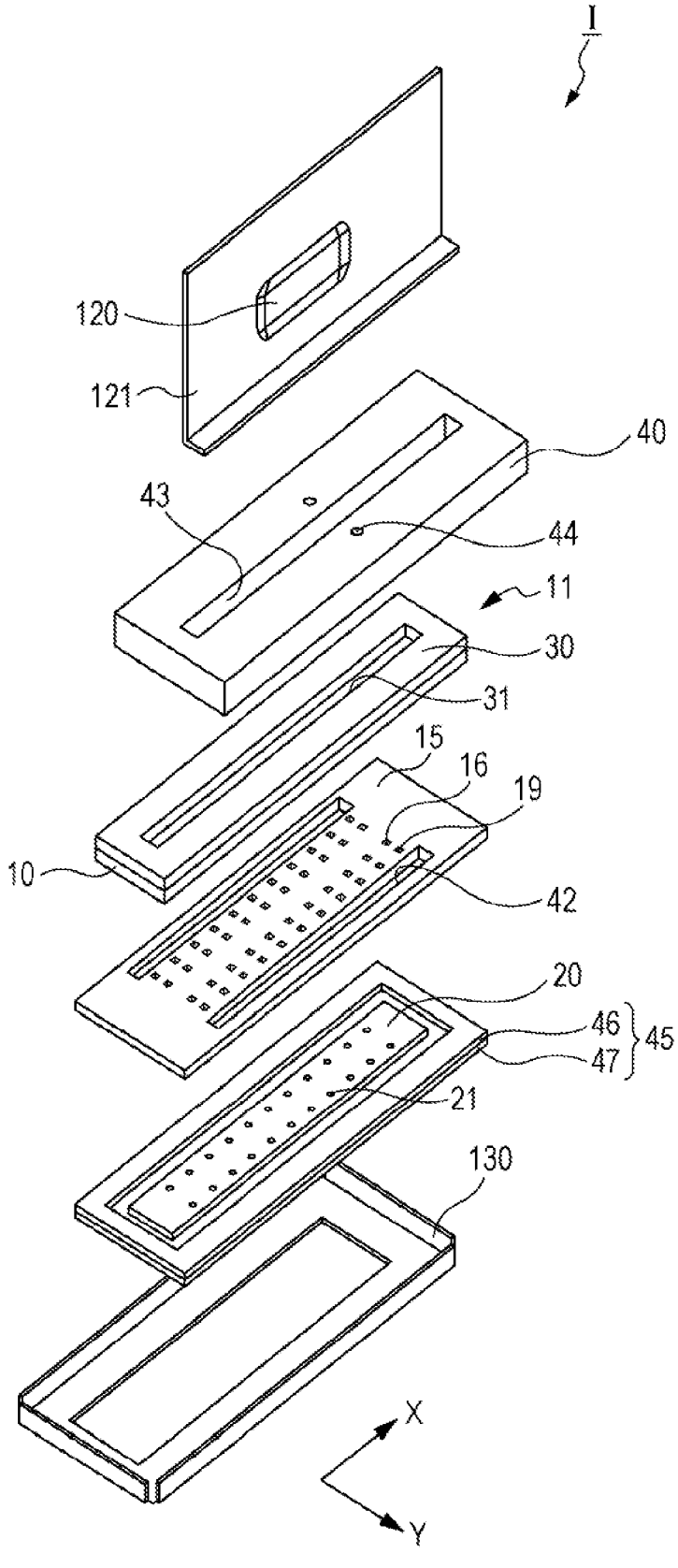
FIG. 5 is an exploded perspective view illustrating a recording head according to a second embodiment.
Figure 6:
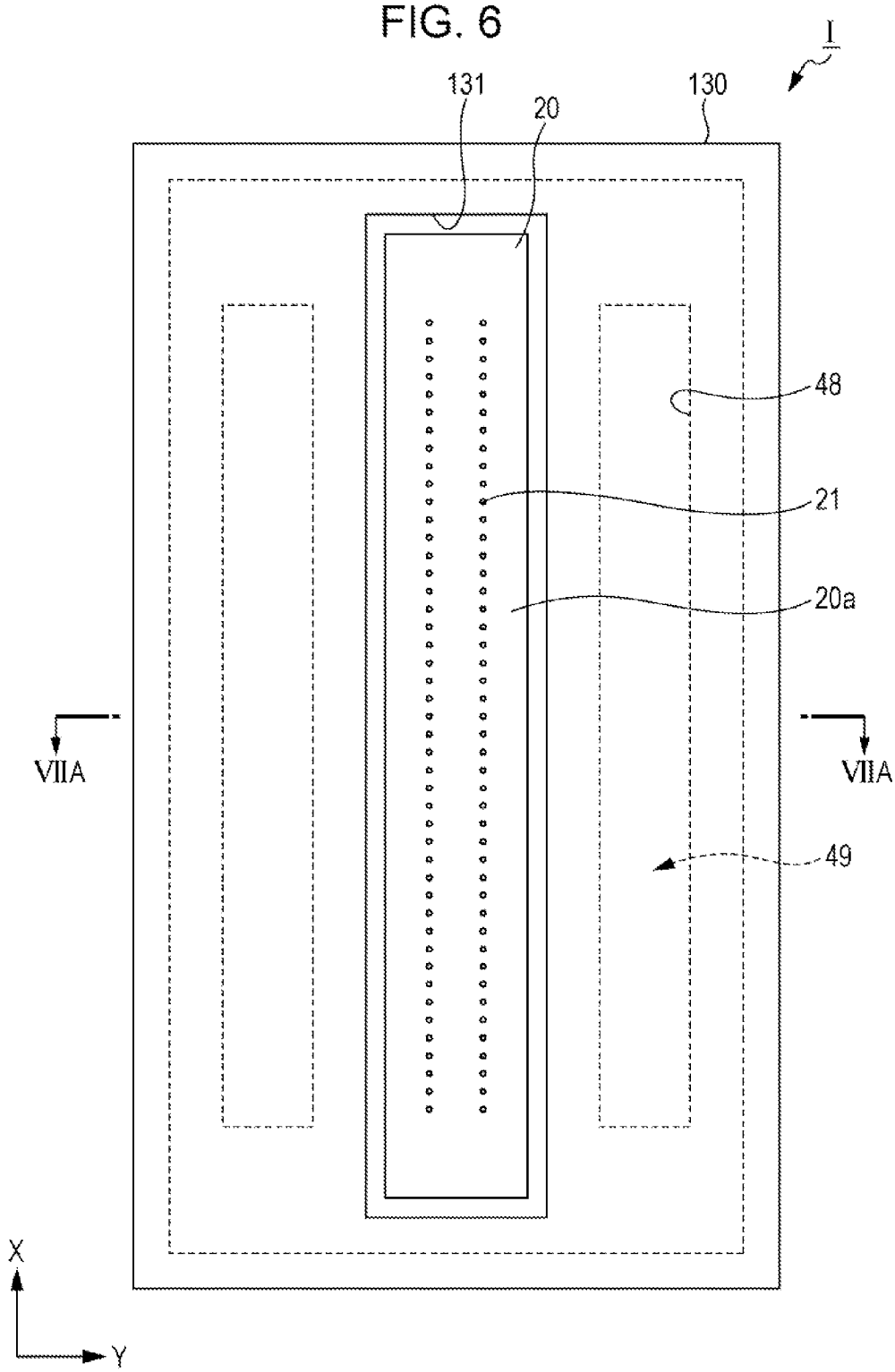
FIG. 6 is a plan view illustrating the recording head according to the second embodiment.
Figure 7A:
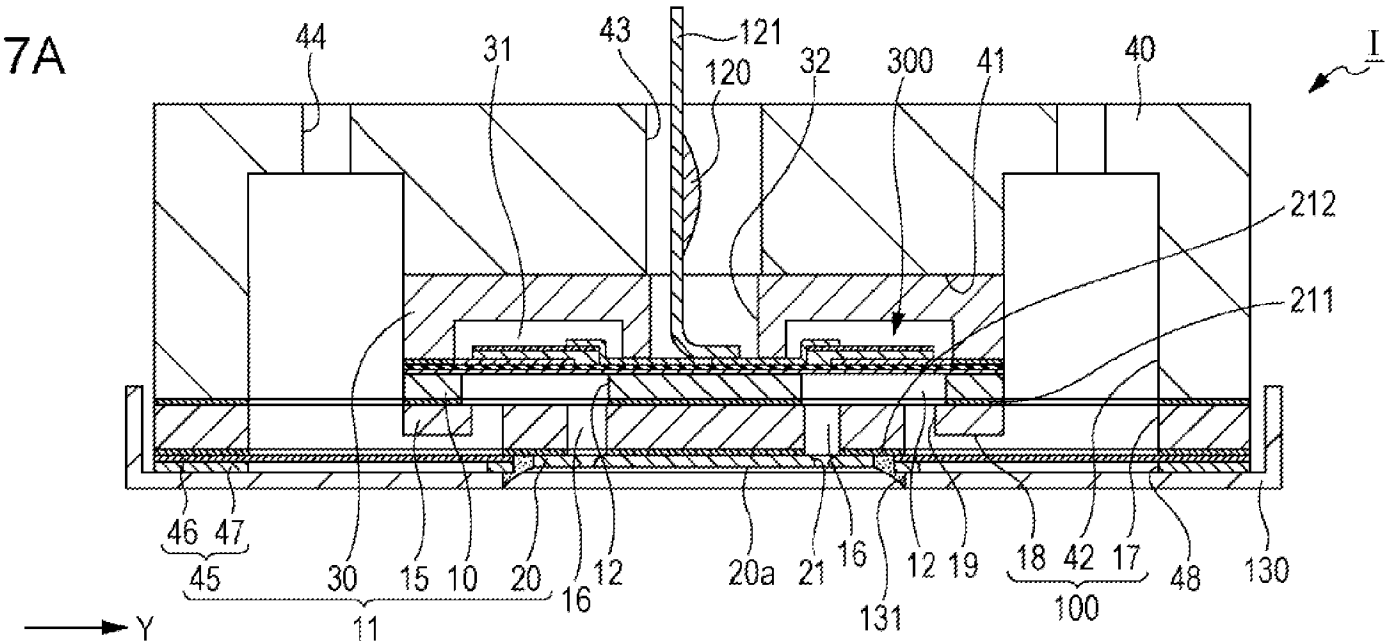
FIGS. 7A and 7B are cross-sectional views illustrating the recording head according to the second embodiment.
Figure 7B:
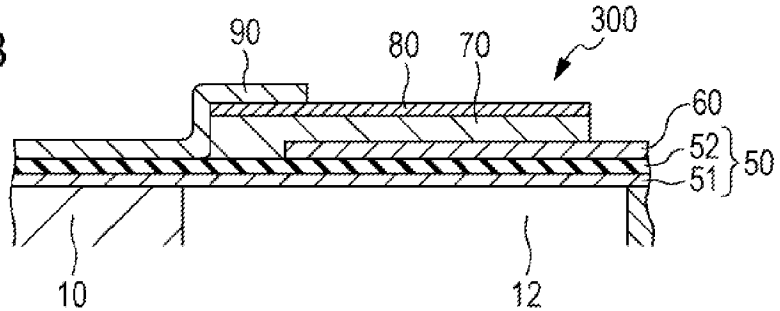
Figure 8A:
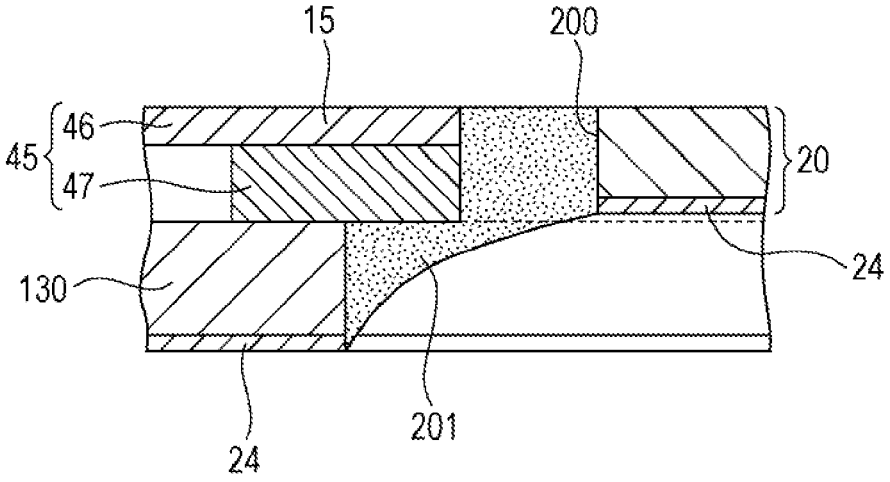
FIGS. 8A and 8B are cross-sectional views illustrating main parts of the recording head according to the second embodiment.
Figure 8B:
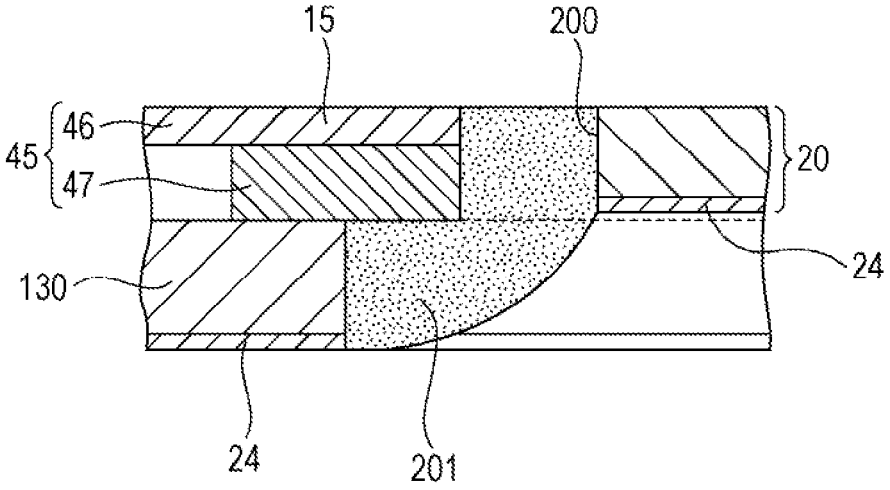
Figure 9:
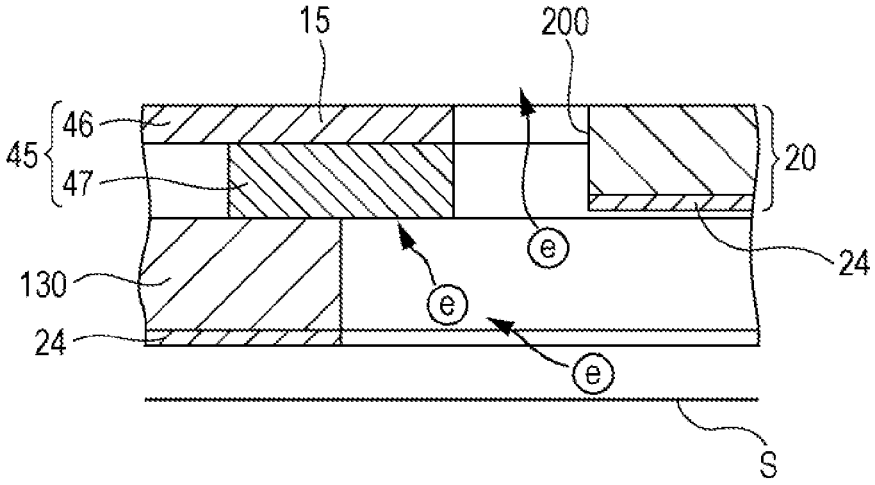
FIG. 9 is a schematic view illustrating an existing liquid discharging head.

FIG. 5 is an exploded perspective view illustrating the ink jet recording head as an example of the liquid discharging head according to the second embodiment of the invention. FIG. 6 is a plan view illustrating the ink jet recording head as an example of the liquid discharging head according to the second embodiment of the invention. FIG. 7A is a cross-sectional view cut along a line VIIA-VIIA in the ink jet recording head of FIG. 6 and FIG. 7B is a cross-sectional view illustrating main parts thereof in an enlarged manner. FIGS. 8A and 8B are cross-sectional views illustrating main parts in an enlarged manner for explanation. FIG. 9 is a view for explaining flow of static electricity in the existing liquid discharging head.

As illustrated in the drawings, the ink jet recording head I as an example of the liquid discharging head according to the embodiment includes a plurality of members such as a head main body 11 and a case member 40. The plurality of members are bonded to one another with an adhesive or the like. In the embodiment, the head main body 11 includes a flow path formation substrate 10, a communication plate 15, a nozzle plate 20, a protection substrate 30, and a compliance substrate 45. Although detail description will be made later, the flow path formation substrate 10, the communication plate 15, the nozzle plate 20, and the protection substrate 30 are formed by silicon substrates (silicon single crystal substrates) in the embodiment. That is to say, in the embodiment, the substrates on which flow paths including nozzle openings 21 are formed and that are laminated with an adhesive correspond to the flow path formation substrate 10, the communication plate 15, the nozzle plate 20, and the protection substrate 30.

The flow path formation substrate 10 constituting the head main body 11 is formed by the silicon single crystal substrate in the embodiment. A plurality of pressure generation chambers 12 are arranged on the flow path formation substrate 10 so as to be in parallel along the first direction X (parallel arrangement direction). The plurality of nozzle openings 21 for discharging ink of the same color are arranged in parallel in the first direction X. In addition, a plurality of rows along which the pressure generation chambers 12 are arranged in parallel in the parallel arrangement direction are arranged on the flow path formation substrate 10 in the second direction Y. In the embodiment, two rows thereof are provided.

As illustrated in FIG. 7A, the communication plate 15 is bonded to one surface side of the flow path formation substrate 10 (at the opposite side to a vibration plate 50, which will be described later) through an adhesive 211. Further, the nozzle plate 20 is bonded to the communication plate 15 through an adhesive 212. The plurality of nozzle openings 21 communicating with the respective pressure generation chambers 12 are bored on the nozzle plate 20. Nozzle communication paths 16 connecting the pressure generation chambers 12 and the nozzle openings 21 are provided on the communication plate 15. The communication plate 15 has an area larger than that of the flow path formation substrate 10 and the nozzle plate 20 has an area smaller than that of the flow path formation substrate 10. The area of the nozzle plate 20 is made relatively smaller so as to reduce the cost. In the embodiment, the surface of the nozzle plate 20 on which the nozzle openings 21 are bored and through which ink droplets are discharged is referred to as a liquid discharge surface 20*a*.

Further, first manifold portions 17 and second manifold portions 18 constituting a part of manifolds 100 are provided on the communication plate 15.

The first manifold portions 17 are provided so as to penetrate through the communication plate 15 in the thickness direction (direction to which the communication plate 15 and the flow path formation substrate 10 are laminated).

Further, the second manifold portions 18 are provided to be opened on the communication plate 15 at the side of the liquid discharge surface 20*a* so as not to penetrate through the communication plate 15 in the thickness direction.

Further, ink supply paths 19 are provided on the communication plate 15 for the respective pressure generation chambers 12 independently. The ink supply paths 19 communicate with one side ends of the pressure generation chambers 12 in the second direction Y. The ink supply paths 19 communicate the second manifold portions 18 and the pressure generation chambers 12.

The communication plate 15 is preferably made of a material having a linear expansion coefficient equivalent to that of the flow path formation substrate 10. That is to say, if a material having a linear expansion coefficient larger than that of the flow path formation substrate 10 is used for the communication plate 15, when the communication plate 15 is heated or cooled, warpage is generated thereon due to the difference in the linear expansion coefficient between the flow path formation substrate 10 and the communication plate 15. In the embodiment, a material same as that of the flow path formation substrate 10, that is, the silicon single crystal substrate is used for the communication plate 15 so as to suppress warpage due to heat.

Further, the nozzle plate 20 is formed by the silicon single crystal substrate. With this, the nozzle plate 20 and the communication plate 15 are made to have equivalent linear expansion coefficients so as to suppress warpage when heated or cooled. It is to be noted that the nozzle plate may be formed by a stainless steel (SUS) plate.

A plurality of rows along which the nozzle openings 21 are arranged in parallel in the first direction X are formed on the nozzle plate 20 in the second direction Y. In the embodiment, two rows thereof are formed. Each nozzle opening 21 is constituted by a cylindrical portion (straight portion) having a constant inner diameter and a tapered portion having an inner diameter that is gradually enlarged toward the pressure generation chamber 12 side from the liquid discharge surface 20*a* side.

Further, a cover head (cover) 130 as a fixing plate in the embodiment is provided on the head main body 11 at the side of the liquid discharge surface 20*a*. The cover head 130 is fixed to the surface of the compliance substrate 45 at the side opposite to the communication plate 15 with an adhesive or the like and seals spaces of compliance portions 49 at the side opposite to the flow paths (manifolds 100). It is to be noted that an exposure opening 131 for exposing the nozzle openings 21 is provided on cover head 130. Further, the cover head 130 is provided such that the end portions thereof are bent so as to cover the side surfaces of the head main body 11. In this manner, the cover head 130 is provided on the outer circumference of the nozzle plate 20 so as to be separated from the nozzle plate 20.

In the embodiment, liquid repellent films 24 having liquid repellent property are provided on the liquid discharge surface 20*a* of the nozzle plate 20 and on a region on the outer surface of the cover head 130 that is parallel with the liquid discharge surface 20*a* (see FIGS. 8A and 8B). That is to say, the liquid repellent films 24 are provided on the surfaces of the nozzle plate 20 and the cover head 130 that are opposed to the discharge target. The liquid repellent property means nature of repelling liquid to be discharged from the ink jet recording head I. That is to say, the liquid repellent property corresponds oil repellent property when a main component of a solution (solvent mainly) of the liquid to be discharged from the ink jet recording head is oil. Alternatively, the liquid repellent property corresponds water repellent property when a main component of a solution (solvent mainly) of the liquid to be discharged from the ink jet recording head is water. The liquid repellent film 24 has the liquid repellent property higher than that of the base material of the nozzle plate 20.

The liquid repellent film 24 is not particularly limited as long as the liquid repellent film 24 has the liquid repellent property for ink. For example, a metal film containing fluorinated polymers, a molecular film of metal alkoxide having liquid repellent property, or the like can be used for the liquid repellent film 24.

The liquid repellent film formed by the metal film containing the fluorinated polymers can be obtained by performing eutectoid plating directly on the liquid discharge surface 20*a* of the nozzle plate 20.

Further, the liquid repellent film formed by the molecular film can be obtained by film-forming the molecular film of metal alkoxide having liquid repellent property, and then, performing drying processing, annealing processing, and the like so as to form a liquid repellent film (silane coupling agent (SCA)) film, for example. When the molecular film of metal alkoxide is used as the liquid repellent film, even when a foundation layer is provided, the liquid repellent film can be formed to be thinner than the liquid repellent film formed by the metal film containing the fluorinated polymers obtained by performing the eutectoid plating. Moreover, in this case, there are advantages that "abrasion-resistant property" with which the liquid repellent property is not deteriorated even if the liquid discharge surface is wiped out by wiping when the liquid discharge surface is cleaned and that the liquid repellent property can be improved. It is needless to say that the liquid repellent film formed by the metal film containing the fluorinated polymers can be also used although the "abrasion-resistant property" and the "liquid repellent property" are lower.

On the other hand, the vibration plate 50 is formed on the other surface of the flow path formation substrate 10 (at the surface side opposite to the communication plate 15). The vibration plate 50 according to the embodiment is constituted by an elastic film 51 formed on the flow path formation substrate 10 and an insulating film 52 formed on the elastic film 51 (see FIG. 7B). It is to be noted that the pressure generation chambers 12 are formed by performing anisotropic etching on the flow path formation substrate 10 from one surface and the other surfaces of the pressure generation chambers 12 are configured by the vibration plate (elastic film 51).

Piezoelectric actuators 300 as pressure generation units in the embodiment are provided on the vibration plate 50. Each piezoelectric actuator 300 is formed by a first electrode 60, a piezoelectric layer 70, and a second electrode 80. The piezoelectric actuator 300 corresponds to a portion including the first electrode 60, the piezoelectric layer 70 and the second electrode 80. In general, any one of the electrodes of the piezoelectric actuator 300 is set to a common electrode and the other one of the electrodes and the piezoelectric layer 70 are patterned for each pressure generation chamber 12. A portion that is constituted by any one of the patterned electrodes and the patterned piezoelectric layer 70 and on which piezoelectric strain is generated by applying a voltage to both the electrodes is referred to as a piezoelectric active portion. In the embodiment, the first electrode 60 is set as the common electrode to the piezoelectric actuators 300 and the second electrodes 80 are set to individual electrodes of the piezoelectric actuators 300. However, there is no problem if they are reversed in consideration of driving circuits and wirings. It is to be noted that in the above-mentioned example, the vibration plate 50 is constituted by the elastic film 51 and the insulating film 52. However, it is needless to say that the invention is not limited to the example. For example, the vibration plate 50 on which any one of the elastic film 51 and the insulating film 52 is provided may be employed or only the first electrode 60 may be made to function as the vibration plate without providing the elastic film 51 and the insulating film 52 as the vibration plate 50. Alternatively, the piezoelectric actuators 300 themselves may also serve as the vibration plate substantially. Note that when the first electrode 60 is provided directly on the flow path formation substrate 10, the first electrode 60 needs to be protected by a film (protection film or the like) having insulating property such that the first electrode 60 and the ink are not conducted with each other.

The piezoelectric layers 70 are made of a piezoelectric material of oxide having a polarization structure that is formed on the first electrode 60. For example, the piezoelectric layers 70 can be made of perovskite oxide expressed by a general expression $ABO_3$. In the general expression $ABO_3$, "A" may contain lead and "B" may contain at least one of zirconium and titanium. For example, the "B" may further contain niobium. To be more specific, lead zirconate titanate ($Pb(Zr,Ti)O_3$: PZT), lead niobate zirconate titanate ($Pb(Zr,Ti,Nb)O_3$: PZTNS) containing silicon, or the like can be used as the piezoelectric layers 70.

Further, the piezoelectric layers 70 may be made of a non-lead-type piezoelectric material containing no lead, for example, composite oxide having a perovskite structure that contains bismuth ferrite or bismuth ferrite manganite and barium titanate or bismuth potassium titanate.

In addition, one ends of lead electrodes 90 are connected to the second electrodes 80. Wiring substrates 121 on which driving circuits 120 are provided, for example, COFs, are connected to the other ends of the lead electrodes 90.

The protection substrate 30 having substantially the same size as the flow path formation substrate 10 is provided on the surface of the flow path formation substrate 10 at the side of the piezoelectric actuators 300. The protection substrate 30 has a holding portion 31 as a space for protecting the piezoelectric actuators 300.

Further, the case member 40 is provided on the head main body 11 having the above-mentioned configuration. The case member 40 and the head main body 11 define the manifolds 100 communicating with the plurality of pressure generation chambers 12. The case member 40 has substantially the same shape as the above-mentioned communication plate 15 when seen from the above. The case member 40 is fixed to the protection substrate 30 with an adhesive and is also fixed to the above-mentioned communication plate 15 with the adhesive. To be more specific, the case member 40 has a recess 41 at the side of the protection substrate 30. The recess 41 has such depth that the flow path formation substrate 10 and the protection substrate 30 are accommodated therein. The recess 41 has an opening area larger than the surface of the protection substrate 30 that is bonded to the flow path formation substrate 10. Further, the opening surface of the recess 41 at the side of the nozzle plate 20 is sealed by the communication plate 15 in a state where the flow path formation substrate 10 and the like are accommodated in the recess 41. With this, third manifold portions 42 are defined by the case member 40 and the head main body 11 on the outer circumferential portions of the flow path formation substrate 10. The manifolds 100 in the embodiment are constituted by the first manifold portions 17 and the second manifold portions 18 that are provided on the communication plate 15, and the third manifold portion 42 defined by the case member 40 and the flow path formation substrate 10.

A resin, a metal, or the like can be used as the material of the case member 40. Further, a material having a linear expansion coefficient equivalent to that of the flow path formation substrate 10 to which the protection substrate 30 is bonded is preferable as the material of the protection substrate 30. In the embodiment, the silicon single crystal substrate is used for the protection substrate 30.

Further, the compliance substrate 45 is provided on the surface of the communication plate 15 on which the first manifold portions 17 and the second manifold portions 18 are opened at the side of the liquid discharge surface 20*a*. The compliance substrate 45 seals the openings of the first manifold portions 17 and the second manifold portions 18 at the side of the liquid discharge surface 20*a*.

The compliance substrate 45 includes a sealing film 46 and a fixing substrate 47 in the embodiment. The sealing film 46 is made of a thin film having flexibility (for example, a thin film made of polyphenylene sulfide (PPS), stainless steel (SUS), or the like and having the thickness of equal to smaller than 20 μm). The fixing substrate 47 is made of a hard material such as a metal like stainless steel (SUS). Regions on the fixing substrate 47 that are opposed to the manifolds 100 correspond to openings 48 on which the fixing substrate 47 is removed completely in the thickness direction. Therefore, one surfaces of the manifolds 100 correspond to compliance portions as flexible portions that are sealed by only the sealing film 46 having flexibility.

Inlet paths 44 that communicate with the manifolds 100 and supply ink to the manifolds 100 are provided on the case member 40. Further, a connection port 43 that communicates with a through-hole 32 of the protection substrate 30 and into which the wiring substrates 121 are inserted are provided on the case member 40.

In the ink jet recording head I having the above-mentioned configuration, when ink is discharged, ink is intaken through the inlet paths 44 from an ink storage unit such as the ink cartridge so as to fill the inner portions of the flow paths from the manifolds 100 to the nozzle openings 21 with the ink. Thereafter, a voltage is applied to the respective piezoelectric actuators 300 corresponding to the pressure generation chambers 12 in accordance with signals from the driving circuits 120. With this, the elastic film 51 and the insulating film 52 are flexurally deformed together with the piezoelectric actuators 300. This increases pressure in the pressure generation chambers 12 so that ink droplets are discharged through the predetermined nozzle opening 21.

As described above, in the ink jet recording head I, the liquid repellent films 24 of the nozzle plate 20 and the cover head 130 are provided on the surfaces of the nozzle plate 20 and the cover head 130 that are opposed to the discharge target. The surfaces on which the liquid repellent films 24 are provided are surfaces with which a wiper makes contact at the time of the cleaning. If a recess 200 (see FIGS. 8A and 8B) is present between the end surfaces of the liquid repellent film 24 provided on the nozzle plate 20 and the nozzle plate 20 and the end surfaces of the liquid repellent film 24 provided on the cover head 130 and the cover head 130, the wiper is caught by the outermost end portion of the liquid repellent film 24 on the nozzle plate 20 that are exposed to the recess 200 and so on and the wiping performance becomes undesirable. Therefore, this problem is required to be prevented from occurring. In addition, if ink is accumulated in the recess 200 and the wiping performance is further lowered, there arises a possibility that the ink accumulated in the recess 200 is wiped the nozzle openings 21. Therefore, this problem is required to be prevented from occurring.

Then, in the embodiment, the recess 200 between the liquid repellent films 24 on the nozzle plate 20 and the cover head 130 (note that the thickness of the liquid repellent films 24 is extremely thin as will be described later so that the recess 200 is considered to be formed between the nozzle plate 20 and the cover head 130) is filled with a filler 201 to prevent the wiper from being caught and prevent ink from being accumulated therein. The filler same as that as described in the first embodiment can be used as the filler 201. In the embodiment, the liquid-like epoxy-based adhesive is used, that is, the filler 201 is made of the cured liquid-like epoxy-based adhesive. In addition, the filler 201 is repelled by the liquid repellent film 24 desirably. In the embodiment, the filler 201 that is repelled by the liquid repellent film 24 is used.

In this case, the liquid repellent films 24 are provided on the nozzle plate 20 and the cover head 130. Therefore, the recess 200 is filled with the filler 201 and the filler 201 does not adhere to the surfaces of the liquid repellent films 24. That is to say, the filler 201 is repelled by the liquid repellent films 24 and only the recess 200 on which the liquid repellent film 24 is not formed is filled with the filler 201. Therefore, the filler 201 does not adhere to the surfaces of the liquid repellent films 24. Accordingly, as illustrated in FIG. 8A, the recess 200 can be embedded with the filler 201 in the slope form. It is to be noted that the thicknesses of the liquid repellent films 24 are made large in the drawings for convenience of illustration. However, the thickness of the liquid repellent films 24 are actually extremely thinner than the sizes of illustrated regions such as the recess 200 so that the liquid repellent property of the side surfaces of the liquid repellent films 24 can be neglected.

In addition, when an amount of the filler 201 is large, the filler 201 runs over the recess 200 as illustrated in FIG. 8B. However, in this case, the wiper can be prevented from being caught and ink can be prevented from being accumulated. Accordingly, it is sufficient that the filler 201 is provided by an amount so as not to extend to the outer side (discharge target side) relative to the liquid repellent film 24 on the cover head 130 while embedding the recess 200. It is the most preferable that the recess 200 be embedded with the filler 201 in the slope form as illustrated in FIG. 8A for preventing the wiper from being caught, of course.

Further, the filler 201 and the liquid repellent films 24 in the embodiment have insulating property. The recess 200 between the nozzle plate 20 and the cover head 130 is embedded with the filler 201 having the insulating property, thereby preventing static electricity from reaching the piezoelectric actuators 300. That is to say, as illustrated in FIG. 9, when the recess 200 is not embedded with the filler 201, static electricity (e) from the discharge target (recording sheet) S possibly reaches the piezoelectric actuators 300 through the compliance substrate 45, the communication plate 15, and the flow path formation substrate 10 that are conductors through the recess 200.

In contrast, in the embodiment as illustrated in FIGS. 8A and 8B, the recess 200 from which the conductors are exposed is embedded with the filler 201 as the insulating member so that static electricity does not reach the piezoelectric actuators 300. It is to be noted that in the embodiment, there is a region on which a part of the liquid repellent film 24 is not formed at a position in the vicinity of an erected portion of the cover head 130 and the static electricity flows to the earth through the erected portion of the cover head 130 from the region.

As described above, in the embodiment, the recess 200 between the liquid repellent film 24 on the nozzle plate 20 and the liquid repellent film 24 on the cover head 130 is embedded with the filler 201. This makes it possible to prevent the end portions of the nozzle plate 20 from being caught by the wiper and prevent ink from being accumulated in the recess 200.

Third Embodiment

Figure 10:
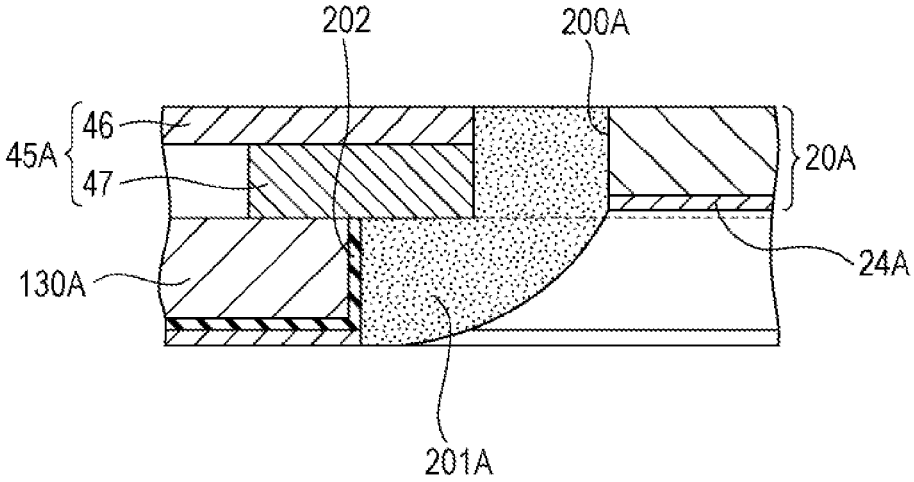
FIG. 10 is a cross-sectional view illustrating main parts of a recording head according to a third embodiment.

In the embodiment, a point that an insulating film 202 is formed on the outer circumference on a cover head 130A in the second embodiment is different from the second embodiment. This point is described with reference to FIG. 10. In the third embodiment, the same reference numerals denote the same constituent components as those in the second embodiment and description thereof is omitted.

To be more specific, the insulating film 202 is formed on the surfaces of the cover head 130A that are opposed to the discharge target and a nozzle plate 20A. If the insulating film is formed in this manner, insulating property can be given to the surfaces of the cover head 130A. A plasma polymerization silicone (PPSi) film is exemplified as the insulating film. Further, if the insulating film 202 is provided, adhesion performance between a liquid repellent film 24A formed by a molecular film and the nozzle plate 20A can be improved. The foundation film formed by the plasma polymerization film can be formed by polymerizing silicone with argon plasma gas. It is to be noted that the insulating film 202 is not limited as long as the insulating film 202 can give the insulating property.

Further, the liquid repellent film 24A is formed on the surface of the insulating film 202 that is opposed to the discharge target. With this, the liquid repellent film 24A is formed on the surface of the cover head 130A, the insulating film 202 is formed on the underlayer of the liquid repellent film 24A, and the foundation of the insulating film 202 corresponds to the main body of the cover head 130A. A recess 200A defined by the nozzle plate 20A, the cover head 130A, the end surfaces of the liquid repellent film 24A on the cover head 130A, and the end surfaces of the liquid repellent film 24A on the nozzle plate 20A is embedded with a filler 201A.

In the embodiment, even when the liquid repellent film 24A does not have the insulating property, static electricity does not reach the piezoelectric actuators 300. Further, the insulating film 202 is formed on the surface of the cover head 130A that is opposed to the nozzle plate 20A. Therefore, even if an amount of the filler 201A is small and a part or all of the surface of the cover head 130A that is opposed to the nozzle plate 20A is exposed, the static electricity does not reach the piezoelectric actuators 300.

Also in the embodiment, the recess 200A is defined by the nozzle plate 20A, the cover head 130A, the liquid repellent film 24A on the nozzle plate 20A, and the liquid repellent film 24A on the cover head 130A (note that the thickness of the liquid repellent film 24A is smaller as described above so that the recess 200A is also considered to be defined by the nozzle plate 20A and the cover head 130A), and the recess 200A is embedded with the filler 201A. This makes it possible to prevent the end portions of the nozzle plate 20A from being caught by the wiper and prevent ink from being accumulated in the recess 200A.

Fourth Embodiment

In the embodiment, the configuration of an ink jet recording head IB is different from that in the second embodiment and is described with reference to FIGS. 11 and 12. In FIGS.

11 and 12, the same reference numerals denote the same constituent components as those in the second embodiment.

Figure 11:
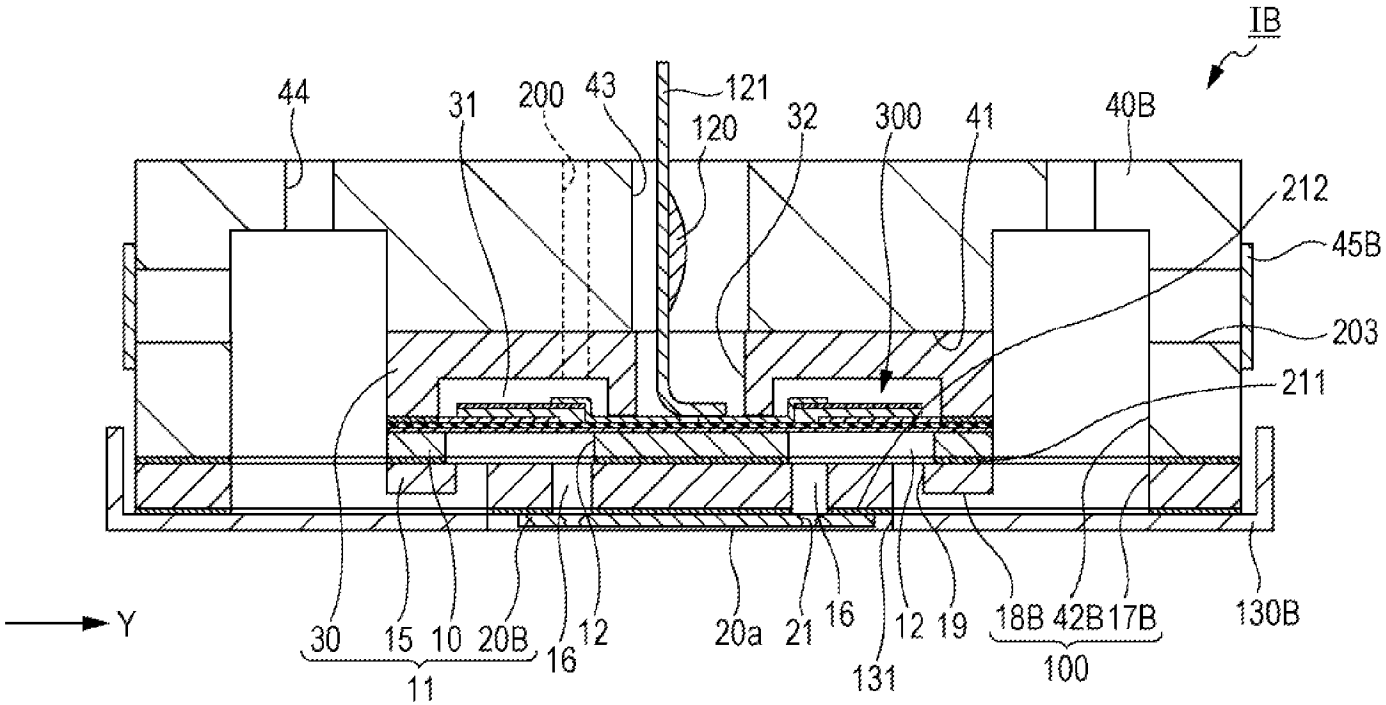
FIG. 11 is a cross-sectional view illustrating a recording head according to a fourth embodiment.

As illustrated in FIG. 11, in the embodiment, through-holes 203 are provided on the side surfaces of a case member 40B so as to communicate with third manifold portions 42B and a compliance substrate 45B is provided so as to cover the through-holes 203.

Further, openings of first manifold portions 17B and second manifold portions 18B at the side of a nozzle plate 20B are sealed by a cover head 130B. The cover head 130B is provided on the outer circumference of the nozzle plate 20B so as to be separated from the cover head 130B.

Figure 12:
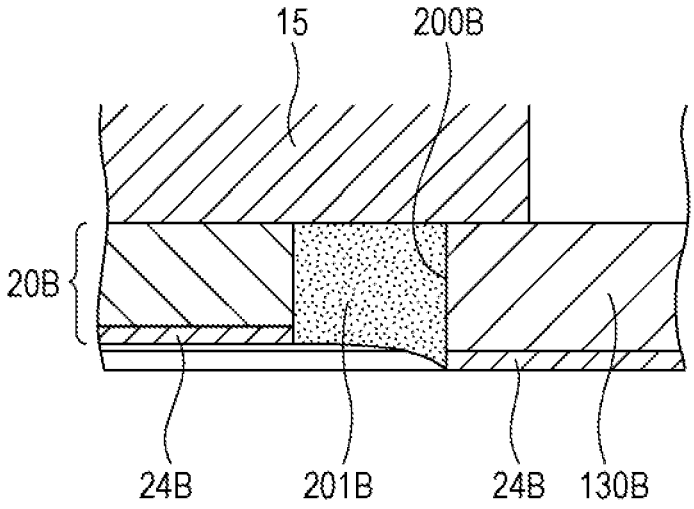
FIG. 12 is a cross-sectional view illustrating main parts of the recording head according to the fourth embodiment.

Also in the ink jet recording head IB, as illustrated in FIG. 12, a recess 200B constituted by the end surfaces of the nozzle plate 20B, the end surfaces of the cover head 130B, the end portions of the liquid repellent film 24B on the cover head 130B and the end surfaces of the liquid repellent film 24B on the nozzle plate 20B is defined. The recess 200B is embedded with a filler 201B.

Also in the ink jet recording head IB, the recess 200B is embedded with the filler 201B. This makes it possible to prevent the end portions of the nozzle plate 20A from being caught by the wiper and prevent ink from being accumulated in the recess 200B. Further, the recess 200B is embedded with the filler 201B so that the piezoelectric actuators 300 can be protected from the static electricity from the discharge target.

Other Embodiments

The invention is not limited to the above-mentioned embodiments. For example, if the nozzle plate 111 and the fixing plate in the first embodiment are provided so as to be separated from each other and a recess is formed between the nozzle plate 111 and the fixing plate, the filler may be provided so as to embed the recess. Further, the embodiments can be combined. For example, the insulating film 202 may be provided on the nozzle plate 20B in the fourth embodiment.

In the above-mentioned embodiments, the liquid repellent films are provided on the fixing plate and the cover head. However, the invention is not limited thereto. The liquid repellent films may not be formed on the fixing plate and the cover such as the cover head.

In the above-mentioned first embodiment, the water repellent films are formed. However, the invention is not limited thereto. The liquid repellent film as described in the second embodiment may be employed. Further, the insulating film 202 may be formed on the nozzle plate 111 in the first embodiment.

In the above-mentioned embodiments, the opening of the recess 200 is embedded with the filler in the slope form for the step portion, and the recesses 200, 200A, and 200B. However, the invention is not limited thereto. If the recess 200 is filled with the filler, the end portions of the nozzle plate 20 can be prevented from being caught by the wiper and ink can be prevented from being accumulated in the recess 200 in comparison with a case where the filler is not provided.

In the above-mentioned ink jet recording apparatus II, the recording heads I are mounted on the carriage 3 and are moved in the main scanning direction. However, the invention is not particularly limited thereto. For example, the invention can be also applied to a so-called line-type recording apparatus in which the ink jet recording heads I are fixed and printing is performed by moving the recording sheet S such as paper in the sub scanning direction only.

In the above-mentioned example, the ink jet recording apparatus II has the configuration in which the ink cartridges 2 as the ink storage units are mounted on the carriage 3. However, the invention is not particularly limited thereto. For example, the ink storage unit such as an ink tank may be fixed to the apparatus main body 4 and the storage unit and the ink jet recording head I may be connected to each other through a supply pipe such as a tube. Further, the liquid storage unit may not be mounted on the ink jet recording apparatus II.

In the above-mentioned embodiments, the ink jet recording head has been described as an example of a liquid discharging head. Further, the ink jet recording apparatus has been described as an example of a liquid discharging apparatus. However, the invention is widely applied to the general liquid discharging heads and liquid discharging apparatuses. It is needless to say that the invention can be applied to liquid discharging heads and liquid discharging apparatuses that discharge liquids other than ink. Further, other liquid discharging heads include various recording heads to be used in image recording apparatuses such as a printer, coloring material discharge heads to be used for manufacturing color filters such as liquid crystal displays, electrode material discharge heads to be used for forming electrodes such as organic EL displays and surface emitting displays (FED), and bioorganic material discharge heads to be used for manufacturing biochips, for example. In addition, the invention can be also applied to liquid discharging apparatuses including the liquid discharging heads.

What is claimed is:

1. A liquid discharging head comprising:

a liquid discharging head that has a nozzle plate on which a nozzle for discharging liquid onto a discharge target is formed, the nozzle plate including a nozzle surface configured to face the discharge target;

a cover that is provided at a periphery of the nozzle plate, and a liquid repellent film that are provided on surfaces of the nozzle plate and the cover which are opposed to the discharge target, wherein a recess defined by the cover and the nozzle surface of the nozzle plate, and facing towards the nozzle in the nozzle plate, is buried with a filler and inner surfaces of the recess is covered by the filler.

2. The liquid discharging head according to claim 1, wherein the filler has insulating property.

3. The liquid discharging head according to claim 2, wherein the liquid repellent film is not formed on the inner surfaces of the recess.

4. The liquid discharging head according to claim 3, wherein the nozzle plate and the cover are provided to be separated from each other, and the recess is formed by at least an end surface of the nozzle plate and an end surface of the cover that are opposed to each other, and the recess is filled with the filler.

5. The liquid discharging head according to claim 4, wherein the filler does not extend to the discharge target side relative to the liquid repellent film provided on the cover.

6. The liquid discharging head according to claim 5, wherein the filler is made of a cured solid liquid-like epoxy-based adhesive.

7. The liquid discharging head according to claim 2, wherein the nozzle plate and the cover are provided to be separated from each other, and the recess is formed by at least an end surface of the nozzle plate and an end surface of the cover that are opposed to each other, and the recess is filled with the filler.

8. The liquid discharging head according to claim 7, wherein the filler does not extend to the discharge target side relative to the liquid repellent film provided on the cover.

9. The liquid discharging head according to claim 8, wherein the filler is made of a cured solid liquid-like epoxy-based adhesive.

10. The liquid discharging head according to claim 2, wherein the filler does not extend to the discharge target side relative to the liquid repellent film provided on the cover.

11. The liquid discharging head according to claim 10, wherein the filler is made of a cured solid liquid-like epoxy-based adhesive.

12. The liquid discharging head according to claim 2, wherein the filler is made of a cured solid liquid-like epoxy-based adhesive.

13. The liquid discharging head according to claim 1, wherein the liquid repellent film is not formed on the inner surfaces of the recess.

14. The liquid discharging head according to claim 1, wherein the nozzle plate and the cover are provided to be separated from each other, and the recess is formed by at least an end surface of the nozzle plate and an end surface of the cover that are opposed to each other, and the recess is filled with the filler.

15. The liquid discharging head according to claim 1, wherein the filler does not extend to the discharge target side relative to the liquid repellent film provided on the cover.

16. The liquid discharging head according to claim 1, wherein an insulating film is formed on at least a surface of the cover that is opposed to the discharge target.

17. The liquid discharging head according to claim 1, wherein the filler is made of a cured solid liquid-like epoxy-based adhesive.

18. A liquid discharging apparatus comprising the liquid discharging head according to claim 1.

* * * * *